United States Patent [19]

Gingras

[11] 4,202,095

[45] May 13, 1980

[54] STEAK KNIFE

[76] Inventor: Hilaire Gingras, C.P. 1328 475 Cote Joyeuse, Saint-Raymond, Cte Portneuf, Quebec, Canada, G0A 4G0

[21] Appl. No.: 858,781

[22] Filed: Dec. 7, 1977

[51] Int. Cl.[2] ..... B25G 1/00

[52] U.S. Cl. ..... 30/340; 30/165

[58] Field of Search ..... 30/340, 342, 344, 343, 30/165

[56] References Cited

U.S. PATENT DOCUMENTS

| | | | |
|---|---|---|---|
| 424,954 | 4/1890 | Brittin | 30/165 |
| 479,306 | 7/1892 | Roberts | 30/314 X |
| 513,077 | 1/1894 | Bourland | 30/315 X |
| 604,850 | 5/1898 | Wright | 30/165 |
| 637,463 | 11/1899 | Hegarty | 30/314 X |
| 699,815 | 5/1902 | Riddick | 30/317 X |
| 1,008,088 | 11/1911 | Swineford | 30/314 X |
| 1,057,857 | 4/1913 | Leidich | 30/315 |
| 1,323,937 | 12/1919 | Weinbacher | 30/165 |
| 1,398,850 | 11/1921 | Franco | 30/314 X |
| 1,926,944 | 9/1933 | Hester | 30/165 |
| 2,309,219 | 1/1943 | Seely | 30/165 |
| 2,538,442 | 1/1951 | Christie | 30/165 |
| 3,365,797 | 1/1968 | Cook | 30/314 X |
| 3,365,798 | 1/1968 | Cunningham | 30/314 X |
| 3,921,289 | 11/1975 | Hasegawa | 30/342 |

FOREIGN PATENT DOCUMENTS

| | | | |
|---|---|---|---|
| 123566 | 2/1947 | Australia | 30/315 |
| 1683391 | 10/1969 | Fed. Rep. of Germany | 30/314 |
| 717715 | 10/1931 | France | 30/344 |
| 1174727 | 11/1958 | France | 30/340 |
| 393980 | 11/1965 | Switzerland | 30/343 |
| 8264 | of 1839 | United Kingdom | 30/165 |
| 1275955 | 6/1972 | United Kingdom | 30/344 |

*Primary Examiner*—Othell M. Simpson
*Assistant Examiner*—J. T. Zatarga

[57] ABSTRACT

A table knife in the form of a hockey stick providing a straight cutting edge which engages the food to be cut over its entire length when the handle is held at a normal angle. Cutting efficiency is increased.

1 Claim, 3 Drawing Figures

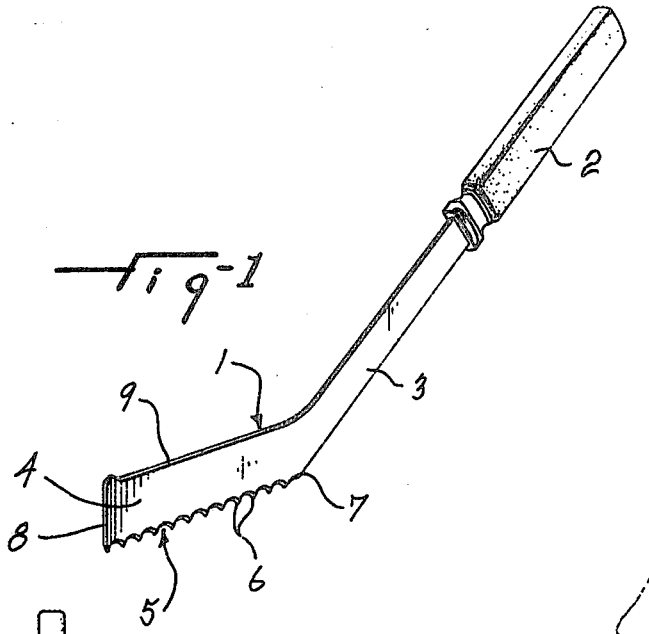
Fig-1
Fig-2
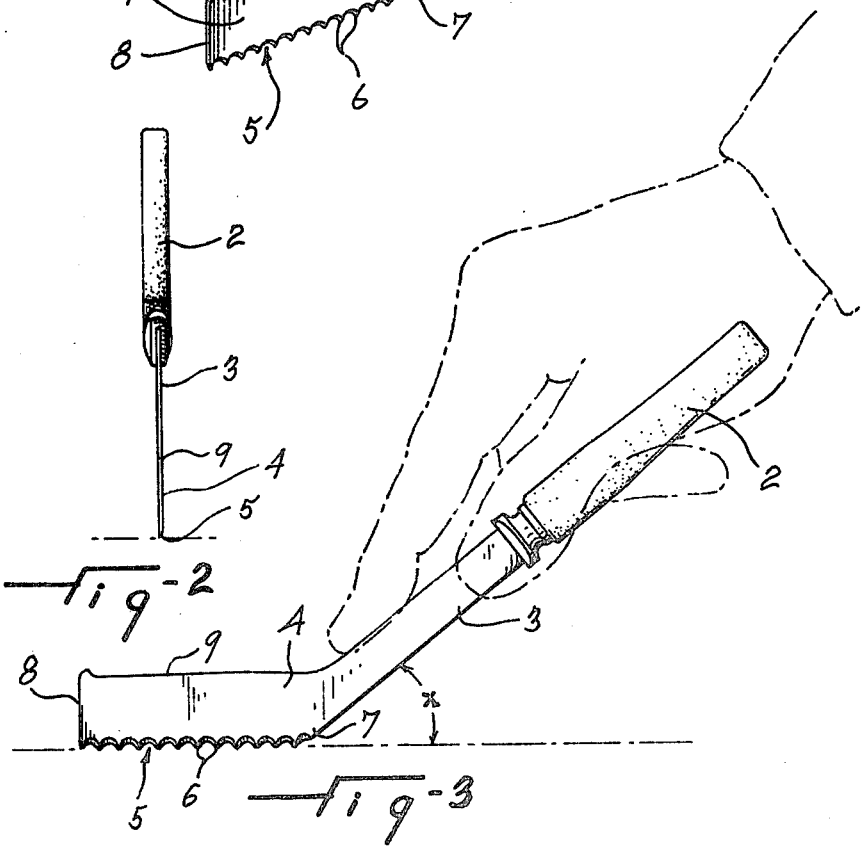
Fig-3

STEAK KNIFE

This invention relates to cutlery and more particularly to a table knife useful for cutting food, more particularly meat.

Traditional knives have the disadvantage of restricting the active cutting edge to the point area of the knife because of the orientation of the handle. The prior art teaches a knife incorporating a curved blade in U.S. Pat. No. 2,538,442 but this knife is for a special application, specifically cutting off and trimming the ribs of a carcass. The present invention provides a knife specifically adapted to eating.

A primary object of the present invention is to provide a knife for cutting food such as steak with greater ease and speed than is possible within an ordinary table knife and which is safer to use especially be blind persons.

The knife of the present invention includes a blade with a straight, bottom cutting edge and an upwardly inclined shank and handle so that the cutting edge can be applied on the meat over substantially its entire length with the handle held in the user's hand in normal position. Preferably, the outer end of the blade is blunt and does not include a pointed tip.

The above will be more clearly understood by referral to the following preferred embodiment of the invention illustrated by way of the accompanying drawings in which:

FIG. 1 is a perspective view of the knife;

FIG. 2 is a front edge view of the knife; and

FIG. 3 is a side view of the knife showing a user's hand in dashed outline.

Like numerals refer to like elements throughout the drawings.

Referring now to the drawings, knife 1 includes a handle 2, a shank 3 and a blade 4. Handle 2 is made conventionally of metal plastic or wood. Obviously shank 3 and handle 2 can be made in a single piece. Shank 3 lies on the same axis as handle 2 and can be made integral therewith. Shank 3 is integral with blade 4 and makes an angle X therewith as shown in FIG. 3 such that the configuration of shank 3 and blade 4 is that of a hockey stick.

Blade 4 has a straight bottom cutting edge 5 preferably formed by serrations 6 extending from the heel 7 where the shank 3 merges with blade 4 to the front outer edge 8. Front edge 8 is blunt and substantially perpendicular to cutting edge 5, rejoining the top edge 9 which is blunt and straight and substantially parallel to cutting edge 5. Shank 3 and blade 4 are made of flat stock and are co-planar angle X is preferably about 40° so that when cutting edge is horizontal, handle 2 is upwardly inclined at an appropriate angle for ease in handling the knife.

It is to be noted that the present invention is of particular value to blind persons as the angular orientation of the shank and handle precludes any accidental injury as well as affording greater ease of use as the entire bottom edge 5 is brought into cutting use when the knife is hand held in normal position.

What I claim is:

1. A steak knife for table use comprising a single-piece blade and shank, made of flat stock, said blade being elongated, having a blunt outer end, an inner end joined to the inner end of said shank, a substantially straight top edge and a substantially straight bottom cutting edge, said straight top edge and said bottom cutting edge being substantially parallel to each other, the cutting edge being provided with serrations throughout its length and extending from the outer end to the inner end of said blade, said shank being elongated with substantially parallel top and bottom straight edges which are closer together than the edges of the blade, said shank bottom edge merging with said cutting edge and making an angle of about 40 degrees with an imaginary straight line projecting from, and aligned with, said cutting edge and an elongated handle fixed to and surrounding the outer end portion of said shank, said handle having its longitudinal axis substantially co-axial with the longitudinal axis of said shank.

* * * * *